US010363567B2

(12) United States Patent
Pringle, IV et al.

(10) Patent No.: US 10,363,567 B2
(45) Date of Patent: Jul. 30, 2019

(54) APPARATUSES FOR APPLYING A GLUTINOUS SUBSTANCE

(71) Applicant: The Boeing Company, Chicago, IL (US)

(72) Inventors: John Walter Pringle, IV, Huntington Beach, CA (US); Solomon Tadesse Atsebha, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 228 days.

(21) Appl. No.: 15/056,529

(22) Filed: Feb. 29, 2016

(65) Prior Publication Data

US 2017/0246654 A1 Aug. 31, 2017

(51) Int. Cl.
*B05C 5/02* (2006.01)
*B05D 1/26* (2006.01)

(52) U.S. Cl.
CPC ..... *B05C 5/0204* (2013.01); *B05D 1/26* (2013.01)

(58) Field of Classification Search
None
See application file for complete search history.

(56) References Cited

U.S. PATENT DOCUMENTS 3,967,581 A * 7/1976 Zirbel ..... B05C 5/0204 118/410
4,778,642 A 10/1988 Lee et al.
5,044,803 A * 9/1991 Kurosawa ..... B05C 17/005 222/570
5,078,527 A * 1/1992 Bell ..... A47G 27/0487 401/193
5,645,785 A * 7/1997 Cornils ..... B29C 47/0019 156/108
6,695,031 B1 * 2/2004 Baltensperger ..... B42C 9/0006 156/556
2006/0213434 A1 * 9/2006 Ganzer ..... B05C 5/0204 118/300
2008/0128430 A1 6/2008 Kovach et al.
2012/0180718 A1 * 7/2012 Martin ..... B05C 5/0204 118/108

FOREIGN PATENT DOCUMENTS

WO 2014063806 A1 5/2014

OTHER PUBLICATIONS

U.S. Patent and Trademark Office, Non-published U.S. Appl. No. 14/703,806, filed May 4, 2015, by Applicant, The Boeing Company.
U.S. Patent and Trademark Office, Non-published U.S. Appl. No. 14/703,779, filed May 4, 2015, by Applicant, The Boeing Company.
U.S. Patent and Trademark Office, Non-published U.S. Appl. No. 14/662,877, filed Mar. 19, 2015, by Applicant, The Boeing Company.

* cited by examiner

*Primary Examiner* — Charles Capozzi
(74) *Attorney, Agent, or Firm* — Joseph F. Harding; The Small Patent Law Group LLC

(57) ABSTRACT

A nozzle for applying a bead of a glutinous substance to a surface of an object comprises a body, a first guide, a gate, a second guide, and a biasing member. The body comprises an inlet opening and an outlet opening, joined by a channel. The first guide is coupled to the body. The gate is translatably coupled to the body. Movement of the gate relative to the body controls flow of the glutinous substance through the outlet opening, and width of the bead. The second guide is coupled to the gate. The biasing member is coupled to the body and to the gate. The biasing member urges the gate toward the first guide.

17 Claims, 11 Drawing Sheets

APPARATUSES FOR APPLYING A GLUTINOUS SUBSTANCE

BACKGROUND

Viscous or glutinous fluids, such as sealants, adhesives, and/or uncured polymers, may be applied to various components. For example, sealants may be applied to composite materials to assemble tanks and/or to insulate edges. Such components to be sealed, however, may have complex geometries, including varying width, varying height, and/or curvature along a length. Current known approaches to applying such materials may be tedious, time consuming, difficult to use in confined spaces, and/or produce finished components with variable quality.

SUMMARY

Accordingly, apparatuses and methods, intended to address at least the above-identified concerns, would find utility.

The following is a non-exhaustive list of examples, which may or may not be claimed, of the subject matter according to the present disclosure.

One example of the subject matter according to the present disclosure relates to a nozzle for applying a bead of a glutinous substance to a surface of an object. The nozzle comprises a body, a first guide, a gate, a second guide, and a biasing member. The body comprises an inlet opening and an outlet opening, joined by a channel. The first guide is coupled to the body. The gate is translatably coupled to the body. Movement of the gate relative to the body controls flow of the glutinous substance through the outlet opening and width of the bead. The second guide is coupled to the gate. The biasing member is coupled to the body and to the gate. The biasing member urges the gate toward the first guide.

Another example of the subject matter according to the present disclosure relates to a method for applying a bead of a glutinous substance to a surface of an object. The method comprises contacting a first guide, coupled to a body of a nozzle, with a first side of the object. The method also comprises biasing a gate, translatably coupled to the body of the nozzle, toward the first guide so that a second guide, coupled to the gate, contacts a second side of the object. Additionally, the method comprises moving the nozzle along the object while maintaining the first guide in contact with the first side of the object and maintaining the second guide in contact with the second side of the object. Further, the method comprises applying the bead of the glutinous substance to the surface via an outlet opening of the nozzle while moving the nozzle along the object. Width of the bead and flow of the glutinous substance through the outlet opening are controlled via movement of the gate relative to the body.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a nozzle, according to one or more examples of the present disclosure;

FIG. 2 is a schematic, perspective view of an object to which glutinous material may be applied by the nozzle of FIG. 1, according to one or more examples of the present disclosure;

FIG. 3 is a schematic, overhead plan view of the object of FIG. 2, according to one or more examples of the present disclosure;

FIG. 4 is a schematic, side elevation view of the object of FIG. 2, according to one or more examples of the present disclosure;

FIG. 5 is a schematic, perspective view of the nozzle of FIG. 1, according to one or more examples of the present disclosure;

FIG. 6 is a schematic, perspective view of the nozzle of FIG. 1, according to one or more examples of the present disclosure;

FIG. 7 is a schematic, side elevation view of the nozzle of FIG. 1, according to one or more examples of the present disclosure;

FIG. 8 is a schematic, side elevational view of the nozzle of FIG. 1, according to one or more examples of the present disclosure;

FIG. 9 is a schematic, side elevation view of the nozzle of FIG. 1, according to one or more examples of the present disclosure;

FIG. 10 is a schematic, side section view of the nozzle of FIG. 1, according to one or more examples of the present disclosure;

FIG. 11 is a schematic, side section view of the nozzle of FIG. 1, according to one or more examples of the present disclosure;

Figure 1:
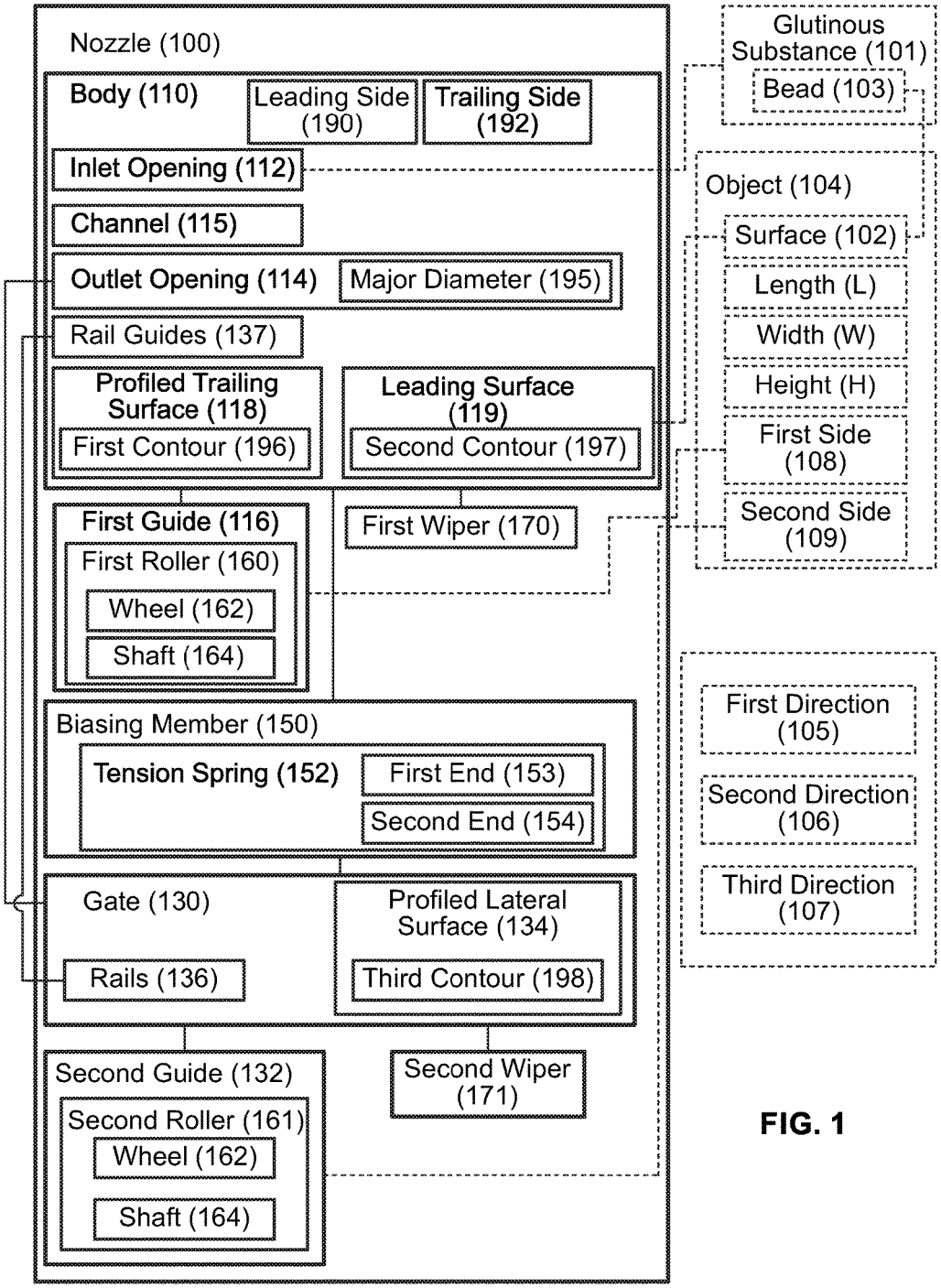
Figure 12:
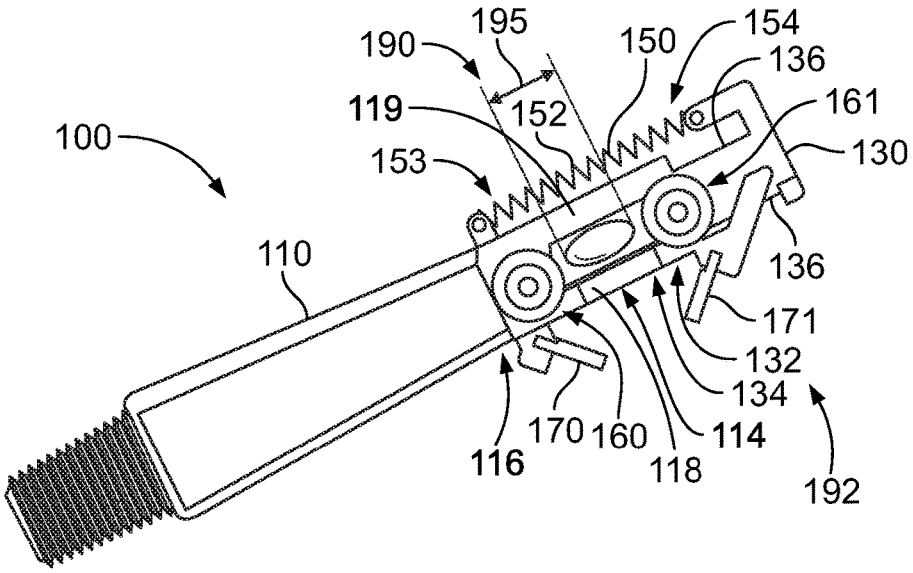
Figure 13:
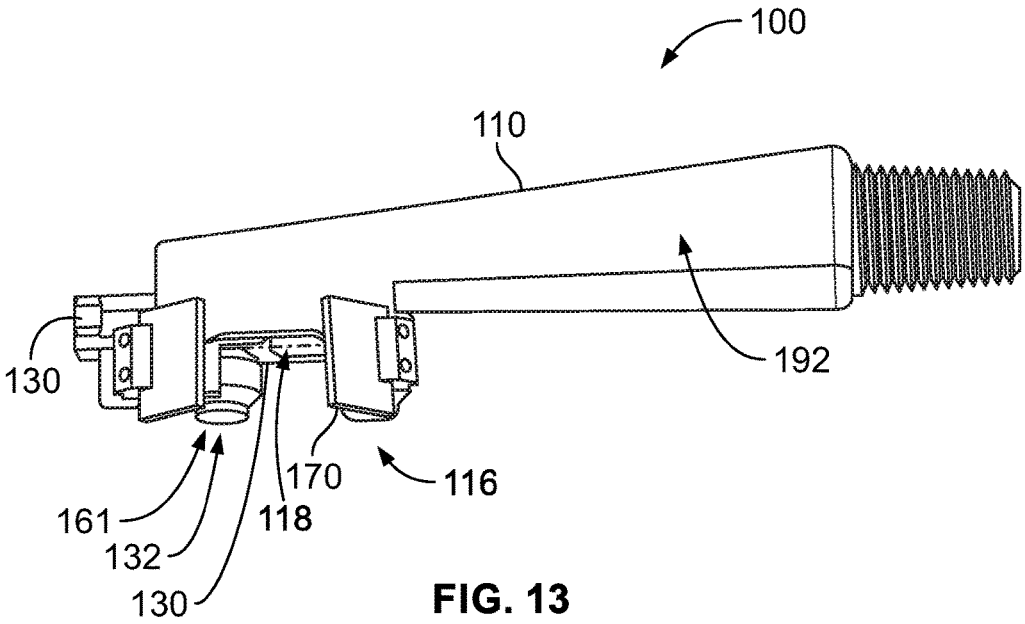
Figure 15:
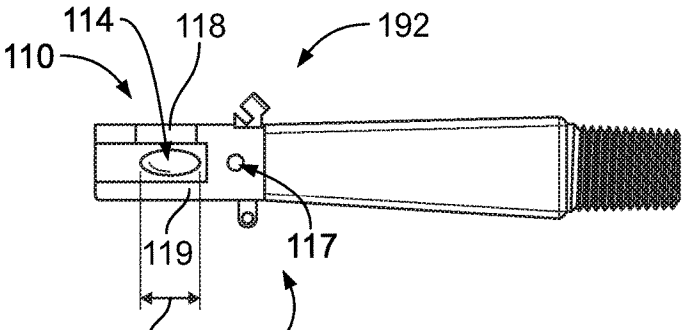
Figure 17:
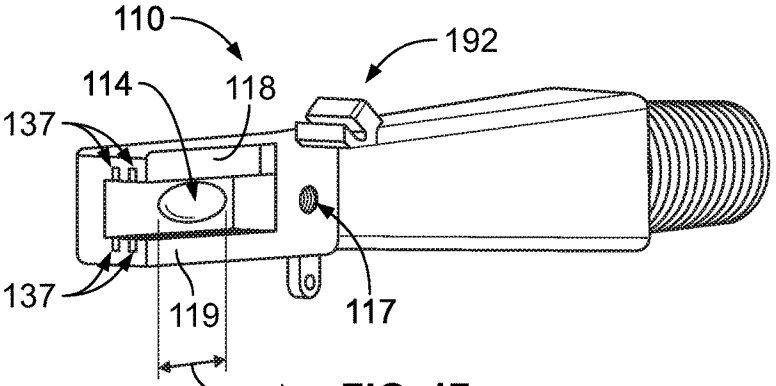
Figure 14:
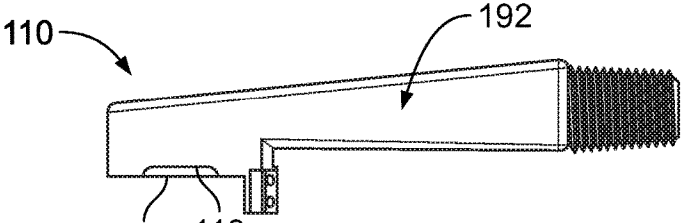
Figure 16:
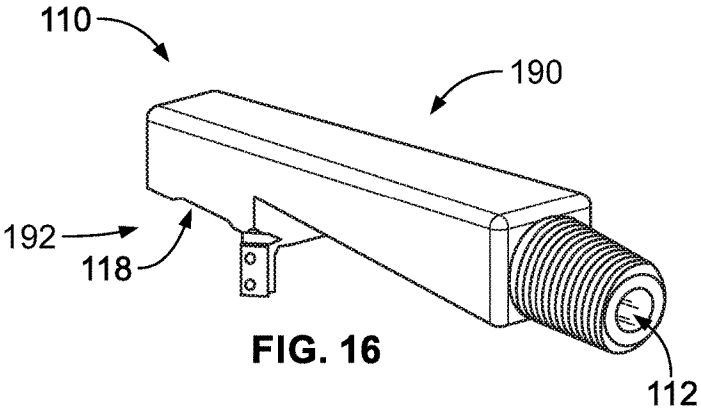
Figure 18:
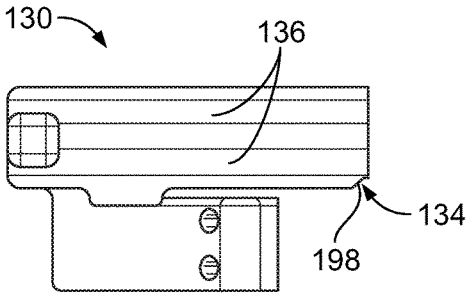
Figure 19:
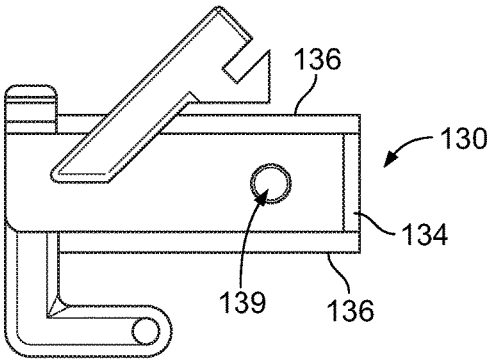
Figure 20:
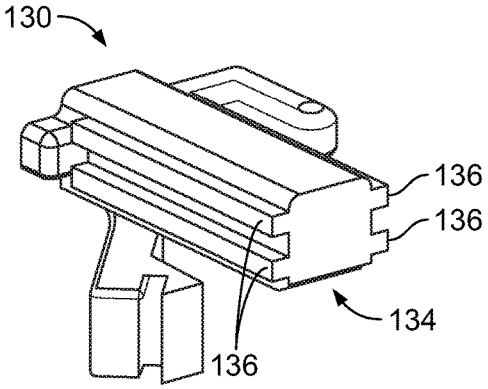
Figure 21:
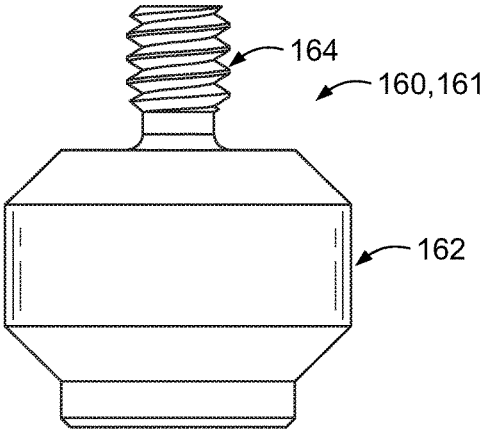
Figure 22:
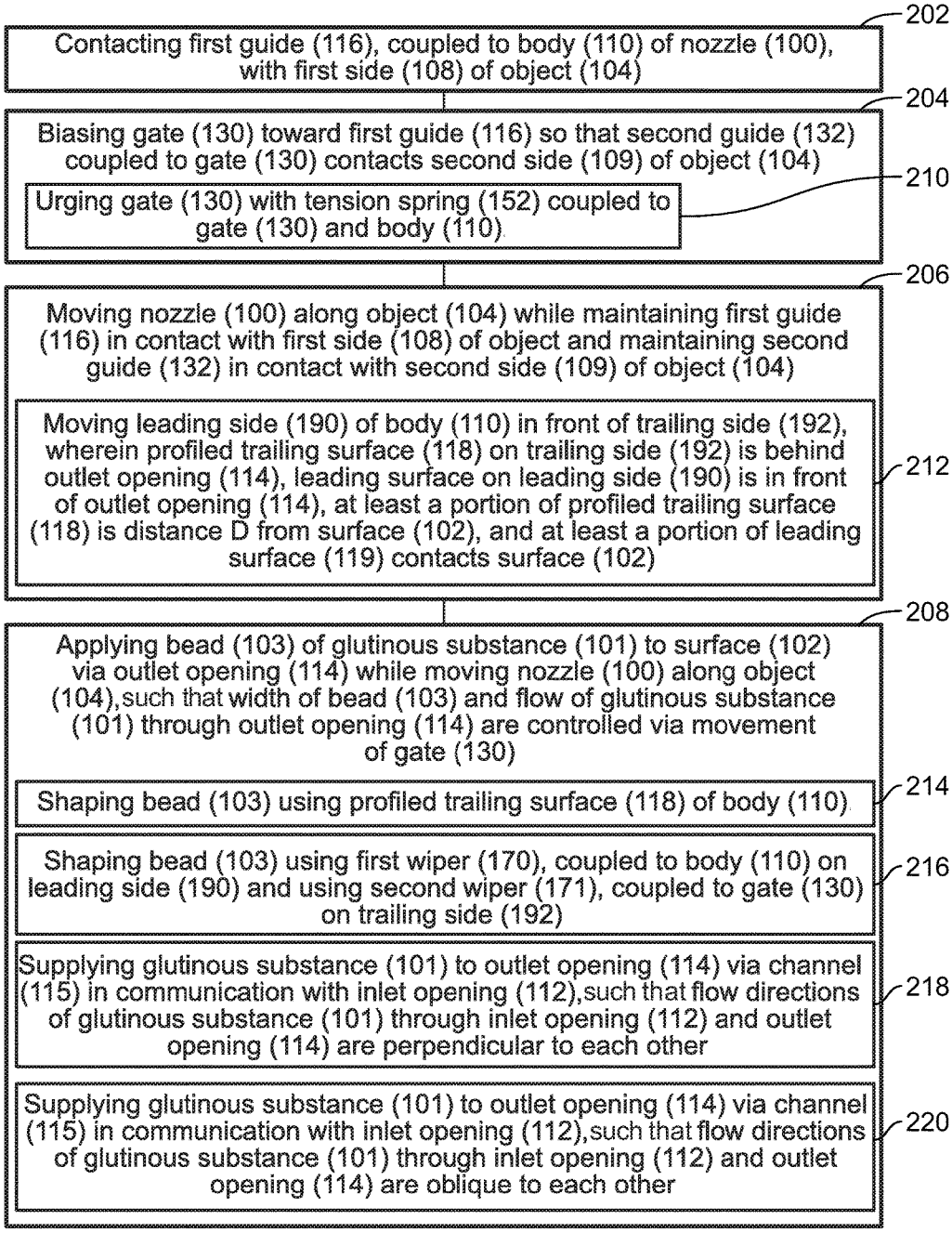
Figure 23:
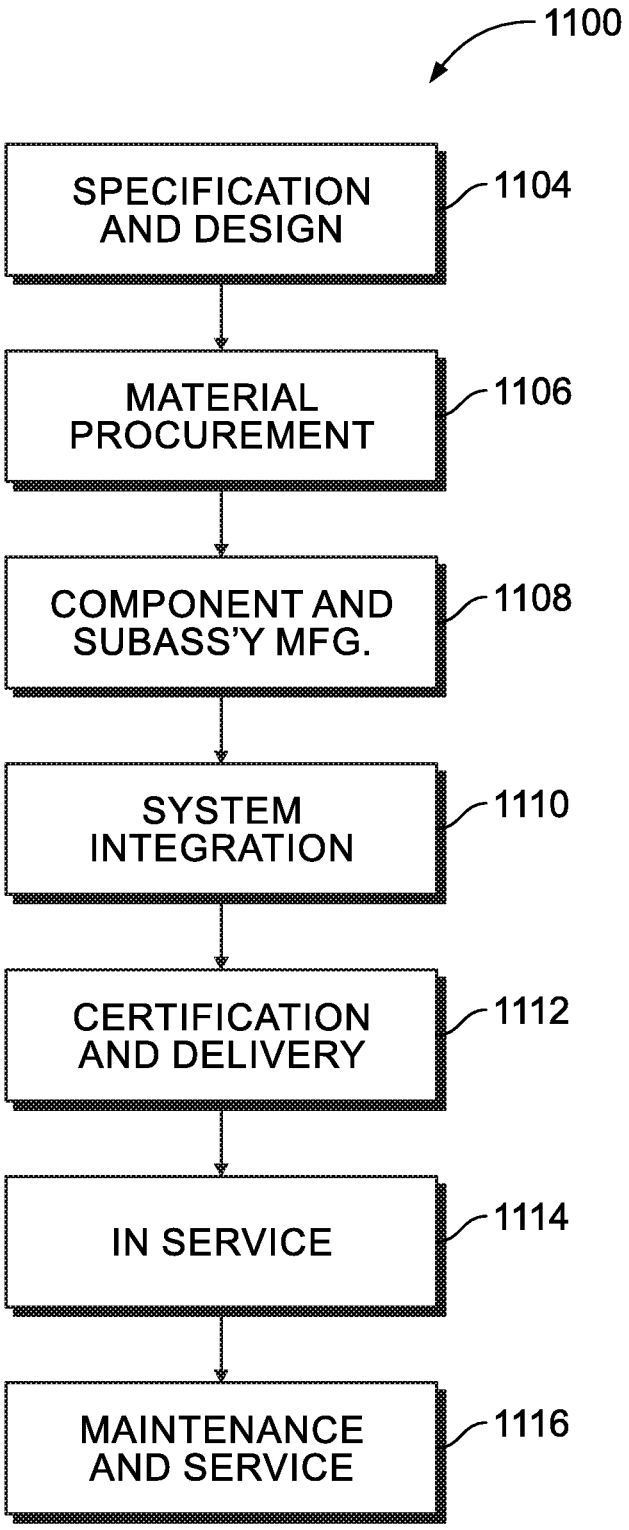
Figure 24:
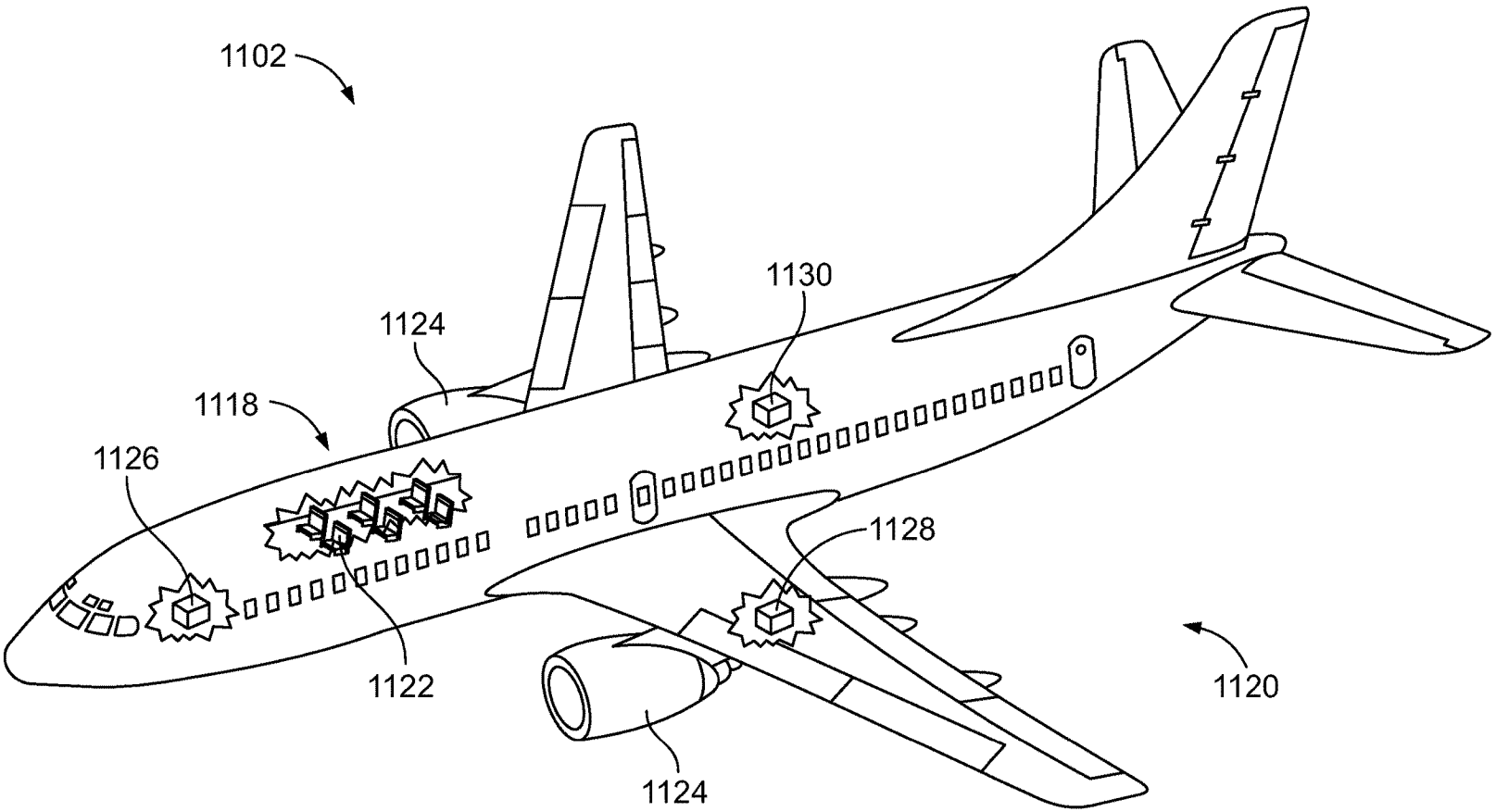

FIG. 12 is a schematic, bottom view of a coupling of the nozzle of FIG. 1, according to one or more examples of the present disclosure;

FIG. 13 is a schematic, side view of the nozzle of FIG. 1, according to one or more examples of the present disclosure;

FIG. 14 is a schematic, side view of a body of the nozzle of FIG. 1, according to one or more examples of the present disclosure;

FIG. 15 is a schematic, bottom view of the body of FIG. 14, according to one or more examples of the present disclosure;

FIG. 16 is a schematic, perspective view of the body of FIG. 14, according to one or more examples of the present disclosure;

FIG. 17 is a schematic, perspective view of the body of FIG. 14, according to one or more examples of the present disclosure;

FIG. 18 is a schematic, bottom view of a gate of the nozzle of FIG. 1, according to one or more examples of the present disclosure;

FIG. 19 is a schematic, bottom view of the gate of FIG. 18, according to one or more examples of the present disclosure;

FIG. 20 is a schematic, perspective view of the gate of FIG. 18, according to one or more examples of the present disclosure;

FIG. 21 is a schematic, top view of a roller of the nozzle of FIG. 1, according to one or more examples of the present disclosure;

FIG. 22 is a block diagram of a method of utilizing the nozzle of FIG. 1, according to one or more examples of the present disclosure;

FIG. 23 is a block diagram of aircraft production and service methodology; and FIG. 24 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 22 and 23, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 22 and 23 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 5-20, nozzle 100 for applying bead 103 of glutinous substance 101 to surface 102 of object 104 is disclosed. Nozzle 100 comprises body 110, comprising inlet opening 112 and outlet opening 114. Inlet opening 112 and outlet opening 114 are joined by channel 115. Nozzle 100 also comprises first guide 116, coupled to body 110. Nozzle 100 further comprises gate 130, translatably coupled to body 110. Movement of gate 130 relative to body 110 controls flow of glutinous substance 101 through outlet opening 114 and width of bead 103. Nozzle 100 additionally comprises second guide 132, coupled to gate 130, and biasing member 150, coupled to body 110 and to gate 130. Biasing member 150 urges gate 130 toward first guide 116. The preceding subject matter of this paragraph characterizes example 1 of the present disclosure.

Use of nozzle 100 provides for improved application of glutinous substance 101, for example improved application of a sealing material to an exposed composite surface, such as an exposed surface of an airplane. Nozzle 100 provides improved access to difficult-to-reach work surfaces. Nozzle 100 provides improved tracking of edges having variations in height and/or width, or edges that curve. Use of nozzle 100 provides improved ability to accurately maintain a desired shape (e.g., width) of a deposited bead (e.g., sealant bead). Also, use of nozzle 100 provides improved centering capability, for example when nozzle 100 is manually articulated by an operator. Nozzle 100 provide a low-profile edge-sealing tool that may be used to deposit a sealant bead with a predetermined cross-sectional geometry (e.g., height and width) onto edge surfaces having variations in one or more of height and width, and/or edges that extend along a curved or non-linear path.

For example, glutinous substance 101 may be a sealing material applied to an exposed edge of a composite material, such as a rib or other feature that has been cut to a desired height or shape. The rib or other feature may be a part of an airplane. For example, when the rib or other feature is formed, a cross-section of layers of a composite material may be exposed by a cutting process to form the rib or other feature, and a sealant may be applied to protect against exposure of the cross-section of layers of the composite material. It may be noted that, in some example, glutinous substance 101 may be provided to inlet opening 112 automatically, and in some examples, glutinous substance 101 may be provided to inlet opening 112 manually (e.g., by an operator actuating a trigger or other mechanism to dispense glutinous substance 101 from a reservoir). Further, it may be noted that, in some examples, body 110 may be translated along object 104 automatically (e.g., via articulation of a robotic arm) while in some examples body 110 may be translated manually. In various examples, body 110, first guide 116, second guide 132, and/or gate 130 may be formed of a plastic material cast or otherwise formed to a desired shape.

Generally, first guide 116 may act along one side of object 104 while second guide 132 acts along an opposite side or feature of object 104. First guide 116 may be maintained against a corresponding side by an operator or robot articulating nozzle 100 along object 104, while biasing member 150 urges second guide 132 against it corresponding side so that width of the bead being applied corresponds to width of surface 102 of object 104 to which glutinous substance 101 is being applied, even as width, height, and/or curvature varies. As second guide 132 translates, gate 130 (which is coupled to second guide 132) also translates across outlet opening 114, acting to limit, define, or control the shape of outlet opening 114, which in turn controls the flow as well as width of the applied bead. For example, as second guide 132 moves away from first guide 116, gate 130 will allow more material to pass through outlet opening 114 and provide a wider bead, but as second guide 132 moves toward first guide 116, gate 130 will allow les material to pass through outlet opening 114 and provide a narrower bead. The particular positions and geometries of first guide 116, second guide 132, gate 130, and outlet opening 114, for example, may be configured so that the edges of an applied bead correspond to or match the edges of surface 102. In some example the bead may be applied to have edges that are flushes with edges of surface 102, while in some examples the bead may extend past the edges of surface 102. Optionally, if the bead extends past the edges of the surface, the portion(s) of the bead extending past the edges may be removed.

Figure 2:
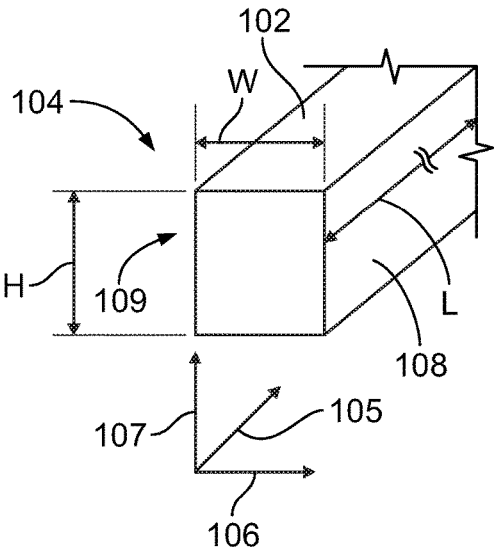
Figure 3:
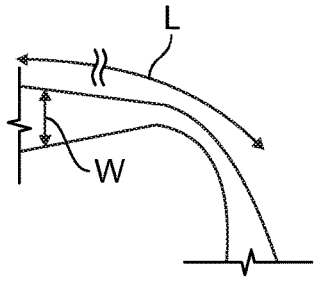
Figure 4:
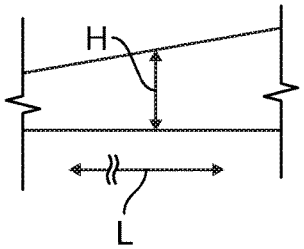
Figure 5:
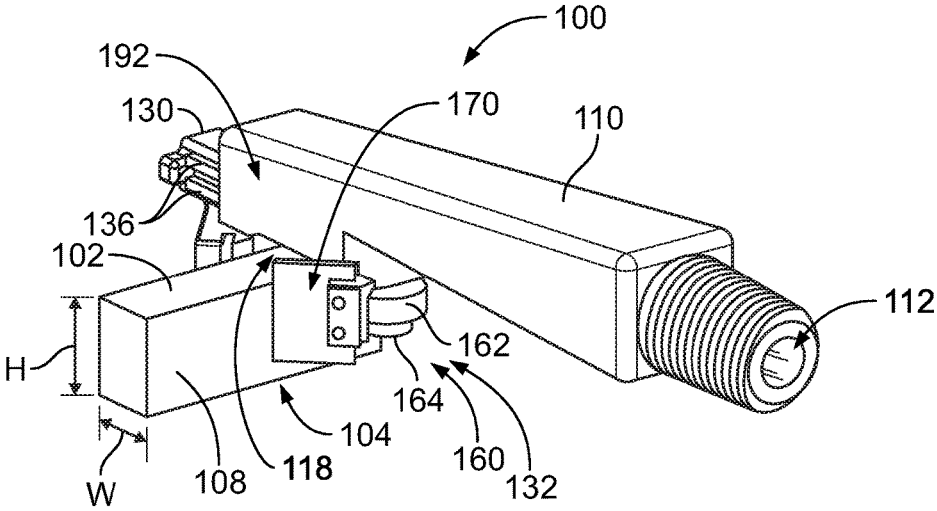
Figure 6:
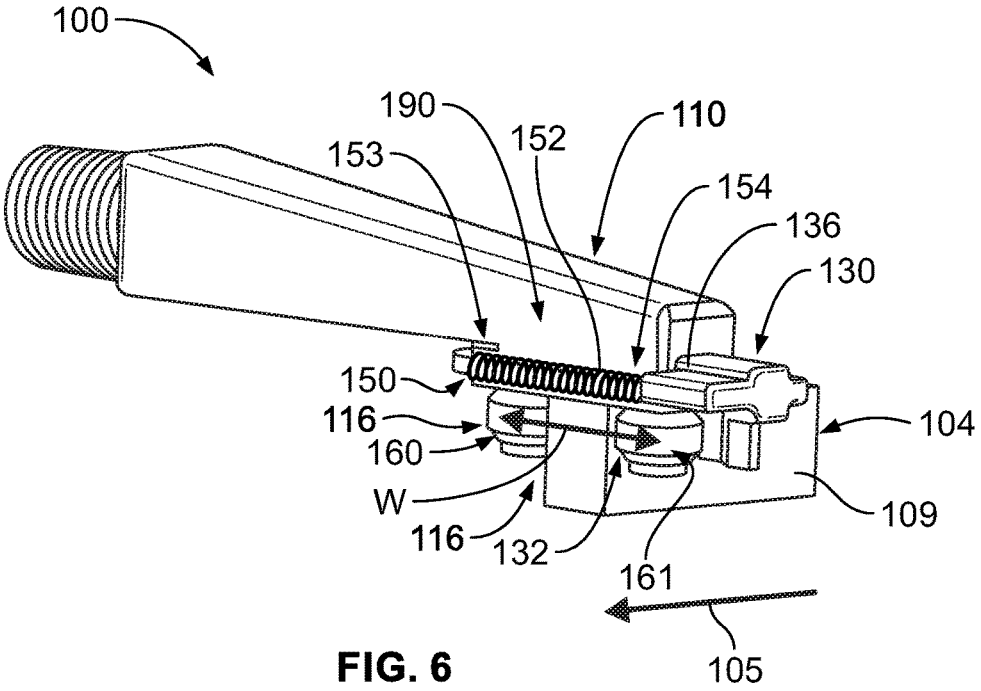
Figure 7:
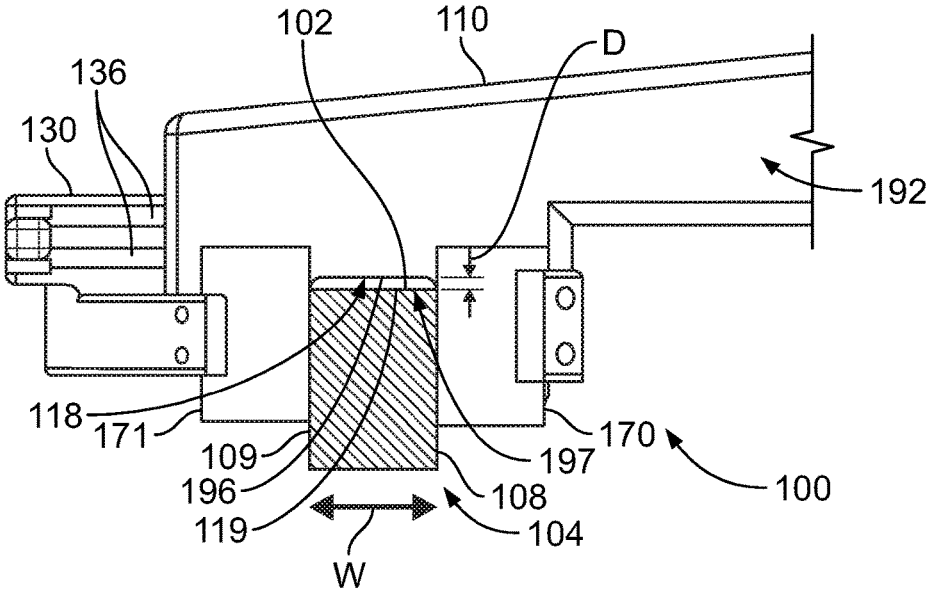
Figure 8:
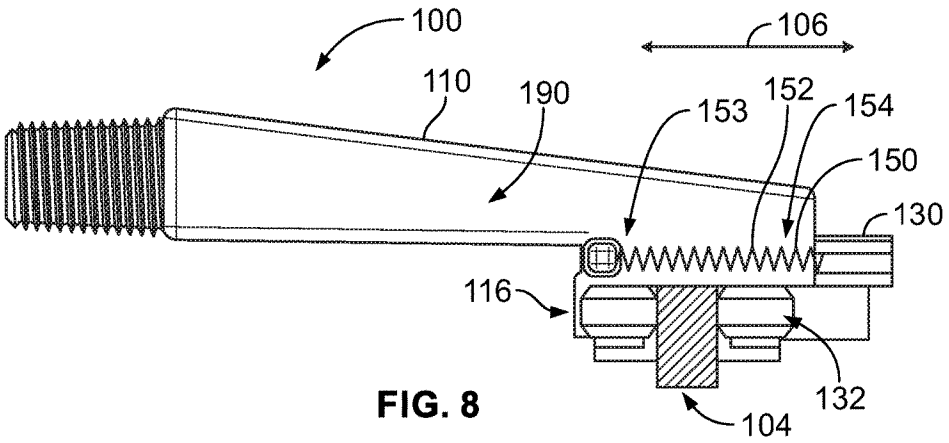
Figure 9:
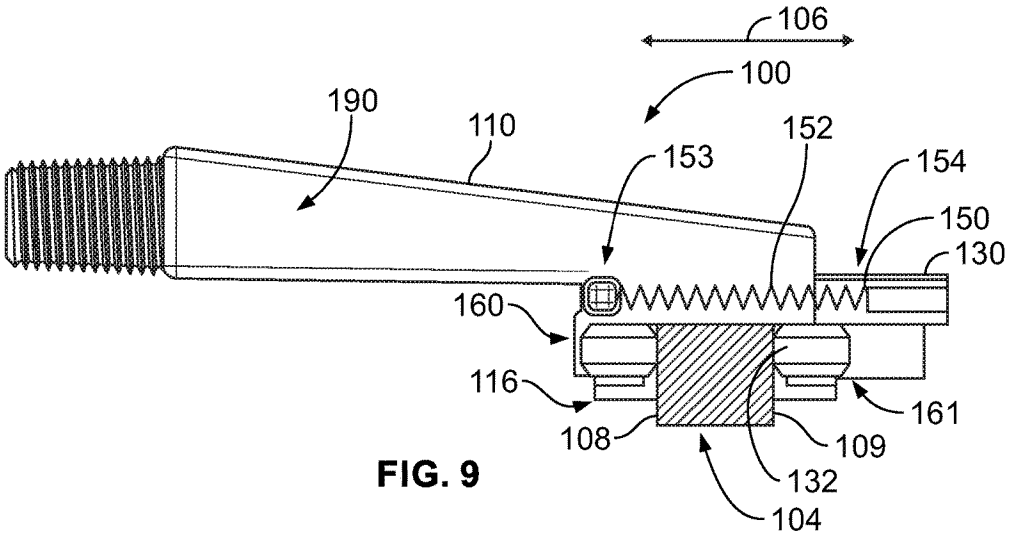
Figure 10:
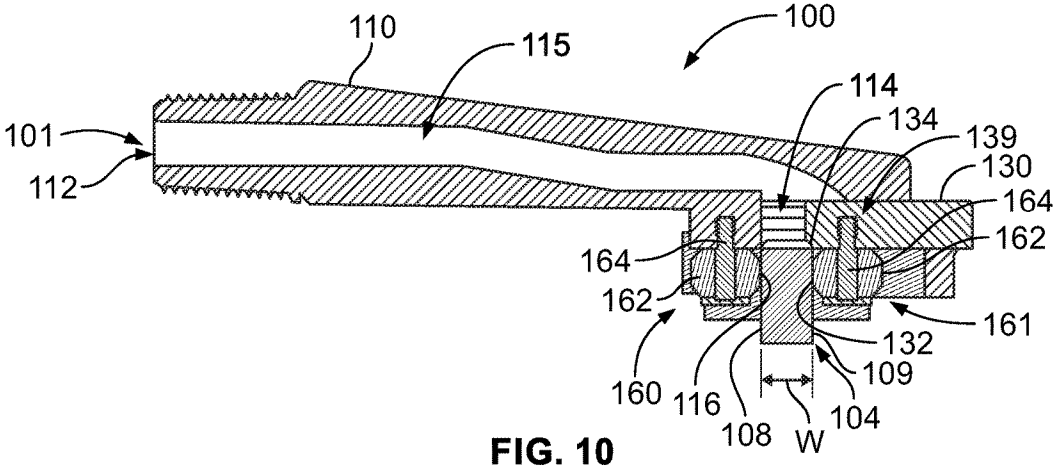
Figure 11:
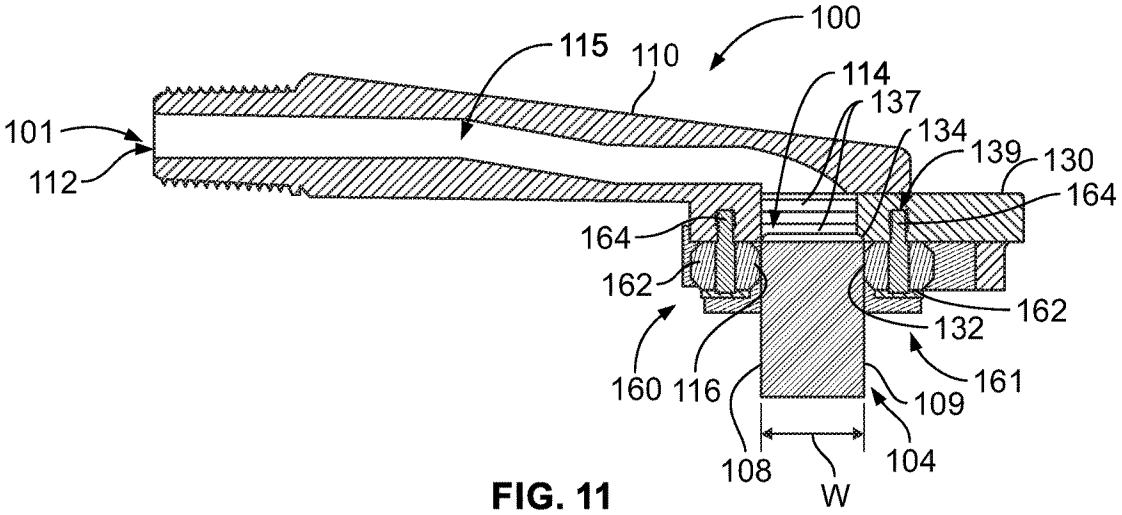

With particular reference to FIGS. 2-7, it may be noted that, for the example illustrated in FIGS. 2-4, surface 102 has length L extending along first direction 105, width W extending along second direction 106, and height H extending along third direction 107. Also, object 104 has first side 108 and second side 109 extending from surface 102, with second side 109 opposed to first side 108. First guide 116 is configured to be constrained in second direction 106 when body 110 traverses along first direction 105 with first guide 116 contacting first side 108 of object 104. Also, gate 130 is configured to be movable along second direction 106 when body 110 traverses along first direction 105 with first guide 116 contacting first side 108 of object 104. Further, biasing member 150 is configured to urge second guide 132 against second side 109 when body 110 traverses along first direction 105. Accordingly, as, for example, width W varies, biasing member 150 maintains second guide 132 against second side 109, and, with gate 130 moving with second guide 132, the width of an applied bead varies corresponding to variation in width W.

Returning to FIGS. 1 and 5-20, it may be noted that, as discussed herein, biasing member 150 may include, for example, one or more springs. Biasing member 150 may be configured to urge gate 130 toward a default or stop position. For example, in a default position (e.g., where no counterforce is provided against biasing member 150 urging second guide 132 toward first guide 116), gate 130 may completely cover or close outlet opening 114, thereby inhibiting or preventing any flow through outlet opening 114 in such a default or closed position.

Referring generally to FIG. 1 and particularly to, e.g., FIGS. 5-17, first guide 116 is translationally fixed relative to body 110. The preceding subject matter of this paragraph characterizes example 2 of the present disclosure, wherein example 2 also includes the subject matter according to example 1, above.

Use of first guide 116 translationally fixed relative to body 110 helps provide for consistent and reliable positioning of body 110 with respect to object 104 (e.g., by urging at least portion of first guide 116 against object 104). Use of first guide 116 translationally fixed relative to body 110 also may reduce a number of moving parts and/or number of total parts, simplify use of nozzle 100, provide improved centering of outlet opening 114 with respect to surface 102, and/or provide a consistent datum or reference point for positioning of outlet opening 114 in body 110.

It may be noted that, as used herein, "translationally fixed" with respect to a specified aspect or component means not able to translate relative to the specified aspect or component. Accordingly, as set forth in example 2 of the present disclosure, first guide 116 is not able to translate relative to body 110. For example, first guide 116 may be integrally formed with body 110, or, as another example, first guide 116 may be mounted to a portion of body 110 that may not translate relative to body 110. It may be further be noted that first guide 116 may be translationally fixed but still allowed a different degree of freedom with respect to body 110. For example, first guide 116 may be translationally fixed with respect to body 110, but include a wheel that may rotate with respect to body 110 while not translating with respect to body 110.

Referring generally to FIG. 1 and particularly to, e.g., FIGS. 5-17, second guide 132 is translationally fixed relative to gate 130. The preceding subject matter of this paragraph characterizes example 3 of the present disclosure, wherein example 3 also includes the subject matter according to any one of examples 1 or 2, above.

Use of second guide 132 translationally fixed relative to gate 130 helps provide for consistent and reliable positioning of gate 130 with respect to object 104 (e.g., by urging at least a portion of second guide 116 against object 104) and other aspects of nozzle 100 including outlet opening 114. Use of first guide 116 translationally fixed relative to body 110 also may simplify use of nozzle 100, provide improved centering of outlet opening 114 with respect to surface 102, and/or provide a consistent datum or reference point for positioning of gate 130 (e.g., positioning of gate 130 with respect to outlet opening 114).

For example, with second guide 132 translationally fixed relative to gate 130, and first guide 116 translationally fixed with respect to body 110 (and to outlet opening 114), movement of second guide 132 may provide predictable and reliable positioning of gate 130 with respect to outlet opening 114 to predictably and reliably control flow of glutinous substance 101 out of outlet opening 114 and onto surface 102 of object 104. It may be further be noted that second guide 132 may be translationally fixed but still allowed a different degree of freedom with respect to gate 130. For example, second guide 132 may be translationally fixed with respect to gate 130, but include a wheel that may rotate with respect to gate 130 while not translating with respect to gate 130.

Referring generally to FIG. 1 and particularly to, e.g., FIGS. 5-7 and 14-20, gate 130 comprises rails 136, body 110 comprises rail guides 137, and rails 136 are slidingly received by rail guides 137. The preceding subject matter of this paragraph characterizes example 4 of the present disclosure, wherein example 4 also includes the subject matter according to any one of examples 1-4, above.

Using rail guides 137 and rails 136 provides for consistent positioning of gate 130 with respect to body 110, maintain a desired alignment, and reduce or eliminate any binding between gate 130 and body 110 that may tend to result from use of biasing member 150.

Rail guides 137 may be cast, molded or otherwise formed integrally with body 110, while rails 136 may be cast, molded, or otherwise formed integrally with gate 130. Alternatively, for example, rails may be formed as part of body 110 while corresponding guides formed as part of gate 130. As seen in the illustrated example, two rails and guides may be used on each side of the gate to provide resistance to binding that may result from bending forces applied laterally as well as elevationally, although other numbers and/or arrangements of rails and guides may be employed in different examples. Also, surfaces of the rails and/or guides may be sanded, polished or otherwise processed to provide reduced friction and improved sliding.

Referring generally to FIG. 1 and particularly to, e.g., FIGS. 5-12, biasing member 150 comprises tension spring 152, having first end 153, coupled to body 110, and having second end 154, coupled to gate 130. The preceding subject matter of this paragraph characterizes example 5 of the present disclosure, wherein example 5 also includes the subject matter according to any one of examples 1-4, above.

Tension spring 152 provides predictable biasing forces over a predetermined range of motion for gate 130. Tension spring 152 provides a readily available, economical example of biasing member 150. As seen, for example, in FIGS. 8-11, tension spring 152 helps maintain gate 130 against object 104 for varying widths of object 104.

The particular dimensions of tension spring 132 may be selected to provide an unstretched length sufficient to position gate 130 to completely close outlet opening 114, while providing a spring tension sufficient to maintain second guide 132 against object 104. In some examples, more than one tension spring may be employed.

Referring generally to FIG. 1 and particularly to, e.g., FIGS. 5-17, body 110 also comprises leading side 190 and trailing side 192 opposite leading side 190. Tension spring 152 is located on leading side 190 of body 110. The preceding subject matter of this paragraph characterizes example 6 of the present disclosure, wherein example 6 also includes the subject matter according to example 5, above.

Positioning tension spring 152 on leading side allows for tension spring 152 to be placed relatively close to surface 152 to reduce the profile of nozzle 100 in use while keeping tension spring 152 from affecting bead of glutinous material 101 that may be present at trailing side 192 as nozzle is used.

Referring generally to FIG. 1 and particularly to, e.g., FIGS. 5-17, nozzle 100 also comprises first wiper 170 coupled to body 110 on trailing side 192 of body 110. The preceding subject matter of this paragraph characterizes example 7 of the present disclosure, wherein example 7 also includes the subject matter according to example 6, above.

First wiper 170 helps form a bead leaving trailing side 192 of body to a desired width and prevent excess application of glutinous substance 101.

First wiper 170 may be made of rubber or other resilient material. First wiper 170 may be disposed at an angle with respect to body 110 and positioned to provide a desired edge location of an applied bead (e.g., flush with edge of surface 102, or extending slightly beyond edge of surface 102).

Referring generally to FIG. 1 and particularly to, e.g., FIGS. 5-17, nozzle 100 also comprises second wiper 171, coupled to gate 130 on trailing side 192 of body 110. The preceding subject matter of this paragraph characterizes example 8 of the present disclosure, wherein example 8 also includes the subject matter according to example 7, above.

Second wiper 171 helps form a bead leaving trailing side 192 of body to a desired width and prevent excess application of glutinous substance 101.

Second wiper 171 may be made of rubber or other resilient material. Second wiper 171 may be disposed at an angle with respect to gate 130 and positioned to provide a desired edge location of an applied bead (e.g., flush with edge of surface 102, or extending slightly beyond edge of surface 102).

Referring generally to FIG. 1 and particularly to, e.g., FIGS. 5-17, body 110 further comprises profiled trailing surface 118 on trailing side 192 of body 110 proximate outlet opening 114. Body 110 also comprises leading surface 119 on leading side 190 of body 110 proximate outlet opening 114. Outlet opening 114 is located between profiled trailing surface 118 and leading surface 119. When nozzle 100 is moved along object 104 with leading side 190 of body 110 in front of trailing side 192 of body 110 to apply bead 103 of glutinous substance 101 to surface 102 of object 104, profiled trailing surface 118 is behind outlet opening 114, leading surface 119 is in front of outlet opening 114, at least a portion of profiled trailing surface 118 is distance D from surface 102 of object 104, and at least a portion of leading surface 119 contacts surface 102 of object 104. The preceding subject matter of this paragraph characterizes example 9 of the present disclosure, wherein example 9 also includes the subject matter according to any one of examples 6-8, above.

Use of leading surface 119 and profiled trailing surface 118 allows for reliable positioning of nozzle 100 with respect to surface 102 and a predictable height of bead 103 applied to surface 102. For example, with leading surface 119 pressed against surface 102, an overall height of bead 103 may correspond to distance D from surface 102 to at least a portion of profiled trailing surface 118.

Referring generally to FIG. 1 and particularly to, e.g., FIGS. 5-17, profiled trailing surface 118 comprises first contour 196. Leading surface 119 comprises second contour 197 that is different from first contour 196 of profiled trailing surface 118. Gate 130 comprises profiled lateral surface 134 that comprises third contour 198. Third contour 198 is identical to at least a portion of first contour 196. The preceding subject matter of this paragraph characterizes example 10 of the present disclosure, wherein example 10 also includes the subject matter according to of example 9, above.

Use of first contour 196 that is different than second contour 197 helps provide for accurate placement of nozzle 100 (e.g., by urging second contour 197 against surface 102) while allowing for control of shape (including height) via the spacing of first contour 196 away from surface 102 when second contour 197 is urged against surface 102. Use of third contour 198 having at least a portion identical to first contour 196 allows for consistent shaping of bead 103 as gate 130 translates toward or away from first guide 116.

A "contour" in various examples discussed herein may be understood as an elevational contour, for example a contour, shape, or profile that corresponds to elevation with respect to surface 102 (or distance from surface 102), in contrast to a contour that extends along a length of surface 102.

Referring generally to FIG. 1 and particularly to, e.g., FIGS. 5-17, second contour 197 of leading surface 119 is linear. The preceding subject matter of this paragraph characterizes example 11 of the present disclosure, wherein example 11 also includes the subject matter according to example 10, above.

Using linear second contour 197 allows for uniform and even placement of leading surface 119 against surface 102 in cases where surface 102 is planar, allowing for reliable positioning of nozzle 100 (e.g., body 110 of nozzle 100) with respect to object 104 as nozzle 100 is translated along surface 102.

Referring generally to FIG. 1 and particularly to, e.g., FIGS. 5-17, at least a portion of profiled trailing surface 118 is curvilinear. The preceding subject matter of this paragraph characterizes example 12 of the present disclosure, wherein example 12 also includes the subject matter according to any one of examples 10 or 11, above.

Use of curvilinear profiled trailing surface 118 allows for shaping of bead 103 in a desired shape (e.g., a curvilinear profile of bead 103) and/or improved spreading of glutinous substance 101 to form bead 103.

Curvilinear profiled trailing surface 118 may be formed to be closer to surface 102 along edges of surface 102 than at a center portion of surface 102. Accordingly, a height of bead 103 may be greater in the center of surface 102, and/or glutinous substance 101 may be spread outward from a central portion toward edges of surface 102.

Referring generally to FIG. 1 and particularly to, e.g., FIGS. 5-13, first guide 116 comprises first roller 160 and second guide 132 comprises second roller 161. The preceding subject matter of this paragraph characterizes example 13 of the present disclosure, wherein example 13 also includes the subject matter according to any one of examples 1-12, above.

Use of first roller 160 and second roller 161 provides smooth and efficient translation of first guide 116 and second guide 132 along object 104. For example, first roller 160 and second roller 161 may contact sides of object 104 and rotate as nozzle 100 traverses along a length of object 104, allowing for low resistance to travel of nozzle 100 while maintaining first guide 116 and second guide 132 in contact with side of object 104 proximate to surface 102.

With particular reference to FIG. 21, it may be noted that first roller 160 and/or second roller 162 may include wheel 162 coupled to shaft 164. Shaft 164 may be configured to be accepted by opening 119 of body 110 and/or opening 139 of gate 130.

Referring generally to FIG. 1 and particularly to, e.g., FIGS. 5-17, flow directions of glutinous substance 101 through inlet opening 112 and through outlet opening 114 are perpendicular to each other. The preceding subject matter of this paragraph characterizes example 14 of the present disclosure, wherein example 14 also includes the subject matter according to any one of examples 1-13, above.

Orientation of inlet opening 114 and outlet opening 112 with at least portions thereof perpendicular to each other allows for a low-profile (e.g., in an elevational direction with respect to surface 102) nozzle 100 that may be used in relatively confined spaces. Use of such an orientation also allows for convenient provision of glutinous substance 101 from a side of object 104 in contrast to requiring delivery from straight above surface 102.

For example, channel 115 may extend along first direction 105 corresponding to width W of object 104 when body 110 traverses along length L of object 104, with inlet opening generally oriented along first direction 105 and outlet opening 114 oriented perpendicular to first direction 105 and toward surface 102. It may be noted that the flows through outlet opening 114 and inlet opening 112 may be perpendicular to each other without flow necessarily taking a 90 degree turn at a point in channel 115, but instead a transition from alignment with inlet opening 112 and outlet opening 114 may be accomplished via a radiused or otherwise curvilinear path, for example.

Referring generally to FIGS. 1 and particularly to, e.g., FIGS. 5-17, flow directions of glutinous substance 101 through inlet opening 112 and through outlet opening 114 are oblique to each other. The preceding subject matter of this paragraph characterizes example 15 of the present disclosure, wherein example 15 also includes the subject matter according to any one of examples 1-13, above.

Orientation of inlet opening 114 and outlet opening 112 with at least portions thereof oblique to each other allows for a low-profile (e.g., in an elevational direction with respect to surface 102) nozzle 100 that may be used in relatively confined spaces. Use of such an orientation also allows for convenient provision of glutinous substance 101 from a side of object 104 in contrast to requiring delivery from straight above surface 102.

As used herein, an oblique angle may be understood as an angle between two lines that are neither parallel nor perpendicular with respect to each other.

Referring generally to FIG. 1 and particularly to, e.g., FIGS. 8-13, outlet opening 114 has an oblong shape that has major diameter 195, oriented parallel to a direction along which gate 130 is translatable relative to body 110. The preceding subject matter of this paragraph characterizes example 16 of the present disclosure, wherein example 16 also includes the subject matter according to any one of examples 1-15, above.

Use of an oblong shape having major diameter 195 oriented parallel to a direction along which gate 130 is translatable relative to body 110 for outlet opening 114 allows for a wide range of motion of gate 130, and helps reduce or minimize the width of nozzle 100 for use in confined spaces. Use of the oblong shape also helps provide more glutinous substance 101 proximate the center of bead 103, where bead height may be the greatest, and/or provides glutinous substance 101 toward a center of surface 102 from where it may be readily spread to cover surface 102.

Referring generally to, e.g., FIGS. 1-7 and particularly to FIG. 22, method 200 for applying bead 103 of glutinous substance 101 to surface 102 of object 104 is disclosed. Method 200 comprises (block 202) contacting first guide 116, coupled to body 110 of nozzle 100, with first side 108 of object 104. Method 200 also comprises (block 204) biasing gate 130, translatably coupled to body 110 of nozzle 100, toward first guide 116 so that second guide 132, coupled to gate 130, contacts second side 109 of object 104. Method 200 further comprises (block 206) moving nozzle 100 along object 104 while maintaining first guide 116 in contact with first side 108 of object 104 and maintaining second guide 132 in contact with second side 109 of object 104. Method 200 additionally comprises (block 208) applying bead 103 of glutinous substance 101 to surface 102 via outlet opening 114 of nozzle 100 while moving nozzle 100 along object 104. Width of bead 103 and flow of glutinous substance 101 through outlet opening 114 are controlled via movement of gate 130 relative to body 110. The preceding subject matter of this paragraph characterizes example 17 of the present disclosure.

Use of nozzle 100 as discussed herein provides for improved application of glutinous substance 101, for example improved application of a sealing material to an exposed composite surface. Method 200 provides improved applicant of glutinous substance 101 to surfaces having variations in height and/or width, or edges that curve. For example, an operator may conveniently urge first guide 116 against one side of object 104 while gate 130 is biased into contact against an opposite side (e.g., via use of a biasing member such as a spring). Method 200 provides improved ability to accurately maintain a desired shape (e.g., width) of a deposited bead (e.g., sealant bead). Also, method 200 provides improved centering capability, for example when nozzle 100 is manually articulated by an operator.

Referring generally to, e.g., FIGS. 1-7 and particularly to FIG. 22, according to method 100, biasing gate 130 toward first guide 116 comprises (block 210) urging gate 130 with tension spring 152, coupled to gate 130 and body 110. The preceding subject matter of this paragraph characterizes example 18 of the present disclosure, wherein example 18 also includes the subject matter according to example 17, above.

Use of tension spring 152 provides for reliable, economical biasing of gate 130 toward first guide 116. For example, nozzle 100 may be configured such that gate 130 is in a closed position when tension spring 152 is at a default position (which may be stretched or un-stretched), with tension spring 152 stretched or expanded to translate gate 130 to a position at which outlet opening 114 is exposed, with tension from tension spring 152 urging gate 130 toward a closed position to maintain second guide (132) which is coupled to gate 130 in contact with a side of object 104.

Referring generally to, e.g., FIGS. 1-7 and particularly to FIG. 22, according to method 200, moving nozzle 100 along object 104 comprises (block 212) moving leading side 190 of body 110 in front of trailing side 192 of body 110 such that profiled trailing surface 118 on trailing side 192 of body 110 is behind outlet opening 114, leading surface 119 on leading side 190 of body 110 is in front of outlet opening 114, at least a portion of profiled trailing surface 118 is distance D from surface 102 of object 104, and at least a portion of leading surface 119 contacts surface 102 of object 104. The preceding subject matter of this paragraph characterizes example 19 of the present disclosure, wherein example 19 also includes the subject matter according to any one of examples 17 or 18, above.

Use of leading surface 119 and profiled trailing surface 118 allows for reliable positioning of nozzle 100 with respect to surface 102 and a predictable height of bead 103 applied to surface 102. For example, an operator may urge leading surface 119 against surface 102 and move nozzle 100 along surface 102 while glutinous substance 101 is passed through outlet opening 114. With leading surface 119 pressed against surface 102, an overall height of bead 103 may correspond to distance D from surface 102 to at least a portion of profiled trailing surface 118.

Referring generally to, e.g., FIGS. 1-7 and particularly to FIG. 22, according to method 200, applying bead 300 of glutinous substance 101 to surface 102 via outlet opening 114 of nozzle 100 comprises (block 214) shaping bead 103 of glutinous substance 101 using profiled trailing surface 118 of body 110. The preceding subject matter of this paragraph characterizes example 20 of the present disclosure, wherein example 20 also includes the subject matter according to example 19, above.

Use of profiled trailing surface 118 allows for reliable and consistent shaping of bead 103 to a desired shape, contour, or profile corresponding to a shape , contour, or profile of profiled trailing surface 118.

Referring generally to, e.g., FIGS. 1-7 and particularly to FIG. 22, according to method 200, applying bead 103 of glutinous substance 101 to surface 102 via outlet opening 114 of nozzle 100 further comprises (block 216) shaping bead 103 of glutinous substance 101 using first wiper 170, coupled to body 110 on trailing side 192 of body 110, and using second wiper 171, coupled to gate 130 on trailing side 192 of body 110. The preceding subject matter of this paragraph characterizes example 21 of the present disclosure, wherein example 21 also includes the subject matter according to example 20, above.

Use of first wiper 170 and second wiper 171 helps form a bead leaving trailing side 192 of body to a desired width and prevent excess application of glutinous substance 101.

Referring generally to, e.g., FIGS. 1-3 and 9 and particularly to FIG. 22, according to method 200, applying bead 103 of glutinous substance 101 to surface 102 via outlet opening 114 of nozzle 100 comprises (block 218) supplying glutinous substance 101 to outlet opening 114 via channel 115 in communication with inlet opening 112 such that flow directions of glutinous substance 101 through inlet opening 112 and through outlet opening 114 are perpendicular to each other. The preceding subject matter of this paragraph characterizes example 22 of the present disclosure, wherein example 22 also includes the subject matter according to any one of examples 17-21, above.

Use of inlet opening 114 and outlet opening 112 providing flows of glutinous substance 101 having at least portions thereof perpendicular to each other allows for a low-profile (e.g., in an elevational direction with respect to surface 102) nozzle 100 that may be used in relatively confined spaces. Use of such an orientation also allows for convenient provision of glutinous substance 101 from a side of object 104 in contrast to requiring delivery from straight above surface 102.

Referring generally to, e.g., FIGS. 1-3 and 9 and particularly to FIG. 22, according to method 200, applying bead 103 of glutinous substance 101 to surface 102 via outlet opening 114 of nozzle 100 comprises (block 218) supplying glutinous substance 101 to outlet opening 114 via channel 115 in communication with inlet opening 112 such that flow directions of glutinous substance 101 through inlet opening 112 and through outlet opening 114 are oblique to each other. The preceding subject matter of this paragraph characterizes example 23 of the present disclosure, wherein example 23 also includes the subject matter according to example 17-21, above.

Use of inlet opening 114 and outlet opening 112 providing flows of glutinous substance 101 having at least portions thereof oblique to each other allows for a low-profile (e.g., in an elevational direction with respect to surface 102) nozzle 100 that may be used in relatively confined spaces. Use of such an orientation also allows for convenient provision of glutinous substance 101 from a side of object 104 in contrast to requiring delivery from straight above surface 102.

Examples of the present disclosure may be described in the context of aircraft manufacturing and service method 1100 as shown in FIG. 23 and aircraft 1102 as shown in FIG.

24. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 24, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A nozzle for applying a bead of a glutinous substance to a surface of an object, the nozzle comprising:

a body, comprising an inlet opening and an outlet opening, wherein the inlet opening and the outlet opening are joined by a channel, the body comprising rail guides;

a first guide, coupled to the body;

a gate, translatably coupled to the body, the gate comprising rails, wherein the rails of the gate are slidingly received by the rail guides of the body, wherein movement of the gate relative to the body controls:

flow of the glutinous substance through the outlet opening, and width of the bead;

a second guide, coupled to the gate; and a biasing member, coupled to the body and to the gate, wherein the biasing member urges the gate toward the first guide.

2. The nozzle according to claim 1, wherein the first guide is translationally fixed relative to the body.

3. The nozzle according to claim 1, wherein the second guide is translationally fixed relative to the gate.

4. The nozzle according to claim 1, wherein the biasing member comprises a tension spring, having a first end, coupled to the body, and a second end, coupled to the gate.

5. The nozzle according to claim 4, wherein the body further comprises a leading side and a trailing side opposite the leading side, wherein the tension spring is located on the leading side of the body.

6. The nozzle according to claim 5, further comprising a first wiper, coupled to the body on the trailing side of the body.

7. The nozzle according to claim 6, further comprising a second wiper, coupled to the gate on the trailing side of the body.

8. The nozzle according to claim 5, wherein:

the body further comprises:

a profiled trailing surface on the trailing side of the body proximate the outlet opening; and a leading surface on the leading side of the body proximate the outlet opening;

the outlet opening is located between the profiled trailing surface and the leading surface; and when the nozzle is moved along the object with the leading side of the body in front of the trailing side of the body to apply the bead of the glutinous substance to the surface of the object, the profiled trailing surface is behind the outlet opening, the leading surface is in front of the outlet opening, at least a portion of the profiled trailing surface is a distance D from the surface of the object, and at least a portion of the leading surface contacts the surface of the object.

9. The nozzle according to claim 8, wherein:

the profiled trailing surface comprises a first contour, the leading surface comprises a second contour that is different from the first contour of the profiled trailing surface, the gate comprises a profiled lateral surface that comprises a third contour, and the third contour is identical to at least a portion of the first contour.

10. The nozzle according to claim 9, wherein the second contour of the leading surface is linear.

11. The nozzle according to claim 9, wherein at least a portion of the first contour of the profiled trailing surface is curvilinear.

12. The nozzle according to claim 1, wherein flow directions of the glutinous substance through the inlet opening and through the outlet opening are perpendicular to each other.

13. The nozzle according to claim 1, wherein the outlet opening has an oblong shape that has a major diameter oriented parallel to a direction along which the gate is translatable relative to the body.

14. The nozzle according to claim 1, wherein the first guide comprises a first roller and the second guide comprises a second roller.

15. The nozzle according to claim 1, wherein the first guide is translationally fixed relative to the body, and the second guide is translationally fixed relative to the gate.

16. The nozzle according to claim 10, wherein at least a portion of the first contour of the profiled trailing surface is curvilinear.

17. The nozzle according to claim 12, wherein the outlet opening has an oblong shape that has a major diameter oriented parallel to a direction along which the gate is translatable relative to the body.

* * * * *